US007752780B2

(12) United States Patent
Johnson et al.

(10) Patent No.: US 7,752,780 B2
(45) Date of Patent: Jul. 13, 2010

(54) HYDRAULIC BACKHOE SHIFT MECHANISM

(75) Inventors: Larry A. Johnson, Burlington, IA (US); Matthew J. Hennemann, Burlington, IA (US); Suhas Katdare, Pune (IN)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 12/268,694

(22) Filed: Nov. 11, 2008

(65) Prior Publication Data

US 2010/0115802 A1 May 13, 2010

(51) Int. Cl.
*E02F 5/02* (2006.01)

(52) U.S. Cl. ..... 37/443; 414/695

(58) Field of Classification Search ..... 37/443, 37/403–409, 468, 466; 414/695, 695.7, 667, 414/671; 172/667, 663, 673
See application file for complete search history.

(56) References Cited

U.S. PATENT DOCUMENTS

| | | | | |
|---|---|---|---|---|
| 1,626,019 | A | | 4/1927 | Whitmire |
| 2,684,773 | A | | 7/1954 | Boyles |
| 2,738,081 | A | | 3/1956 | Lee |
| 2,910,204 | A | | 10/1959 | Wight |
| 3,025,986 | A | | 3/1962 | Arnold et al. |
| 3,033,380 | A | | 5/1962 | Dorkins |
| 3,047,171 | A | | 7/1962 | Long |
| 3,099,358 | A | | 7/1963 | Clark |
| 3,106,305 | A | | 10/1963 | Gehring |
| 3,255,893 | A | | 6/1966 | Hainer et al. |
| 3,436,099 | A | * | 4/1969 | Long ..... 280/456.1 |
| 3,494,636 | A | | 2/1970 | Magee |
| 3,967,744 | A | | 7/1976 | Goyarts |
| 4,003,484 | A | | 1/1977 | Jones et al. |
| 4,039,095 | A | | 8/1977 | Long |
| 4,049,139 | A | | 9/1977 | Stedman |
| 4,078,680 | A | | 3/1978 | Pilch |
| 4,373,856 | A | | 2/1983 | Taylor |
| 4,921,392 | A | * | 5/1990 | Wagner ..... 414/695 |
| 4,941,786 | A | * | 7/1990 | Steinbock ..... 414/695.7 |
| 5,606,809 | A | | 3/1997 | Allen |

* cited by examiner

*Primary Examiner*—Robert E Pezzuto
(74) *Attorney, Agent, or Firm*—Patrick M. Sheldrake; John William Stader; Michael G. Harms

(57) ABSTRACT

An earth-working vehicle, such as a backhoe loader, has an implement, such as a backhoe, mounted in a manner that the implement can be shifted transversely with respect to the vehicle. A hydraulic motor and roller cable or rack are secured to the vehicle main frame and implement supporting plate to position the implement transversely of the vehicle without the jerky movements of prior backhoe loaders.

20 Claims, 5 Drawing Sheets

HYDRAULIC BACKHOE SHIFT MECHANISM

FIELD OF THE INVENTION

The present invention is directed to an earth-working vehicle, such as a backhoe loader, having an implement, such as a backhoe, in which the implement is capable of being shifted transversely of the vehicle.

BACKGROUND OF THE INVENTION

For many years, it has been common to mount the backhoe support structure or swing tower on a frame and utilize a pair of hydraulic cylinders to pivot the tower with respect to the frame. In such a unit, the hydraulic cylinders are usually connected to the boom support or swing tower on opposite sides of the vertical pivot axis between the swing tower and the frame. For example, in one type disclosed in Long U.S. Pat. No. 3,047,171, the free ends of the piston rods of the hydraulic cylinders are connected to the frame structure at spaced locations while the cylinder barrels are connected at transversely spaced points to the swing tower or mast.

In more recent years, an earth-working vehicle of the type disclosed in the Long patent has also been mounted in a manner that the entire unit can be shifted transversely with respect to the vehicle. The frame supporting the mast or tower is supported on transversely extending rails that are secured to the rear end of the vehicle. This allows the operator to position the frame in any one of an infinite number of positions with respect to the fixed rails and readily lock the unit with respect to the rails.

A side-shaft backhoe incorporates a frame which supports the backhoe mechanism and which is mounted for lateral, transverse movement with respect to the tractor or the like on which the backhoe is mounted. This type of backhoe was developed primarily for trenching in confined spaces, such as in close proximity to a house or other obstruction and enables operation closer to the obstructions than if the backhoe were mounted centrally of the rear of the tractor.

Traditionally, an implement bucket has been repositioned by uncontrolled movement of the backhoe while supporting the backhoe bucket teeth on the ground to one side and pushing the slide carrying the backhoe out on the other side using hydraulic cylinders. Some of the side-shift backhoes required complex components including hydraulically or manually operated clamps or pins.

SUMMARY OF THE INVENTION

In one preferred embodiment, an earth-working vehicle, such as a backhoe loader, has an elongated main frame and an implement support slidingly mounted to the main frame. The implement support is mounted at one end of the main frame and is capable of sliding transversely with respect to the elongated main frame. The vehicle also includes a motive means to slide the implement support with respect to the elongated main frame. The motive means includes a hydraulic motor mounted to one of the main frame and the implement support and either a chain having both ends secured to the other of the main frame and the implement support or the rack of a rack and pinion secured to the other of the main frame and the implement support. The hydraulic motor has a driving sprocket to drive the chain or a pinion to drive the rack and slide the implement support.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
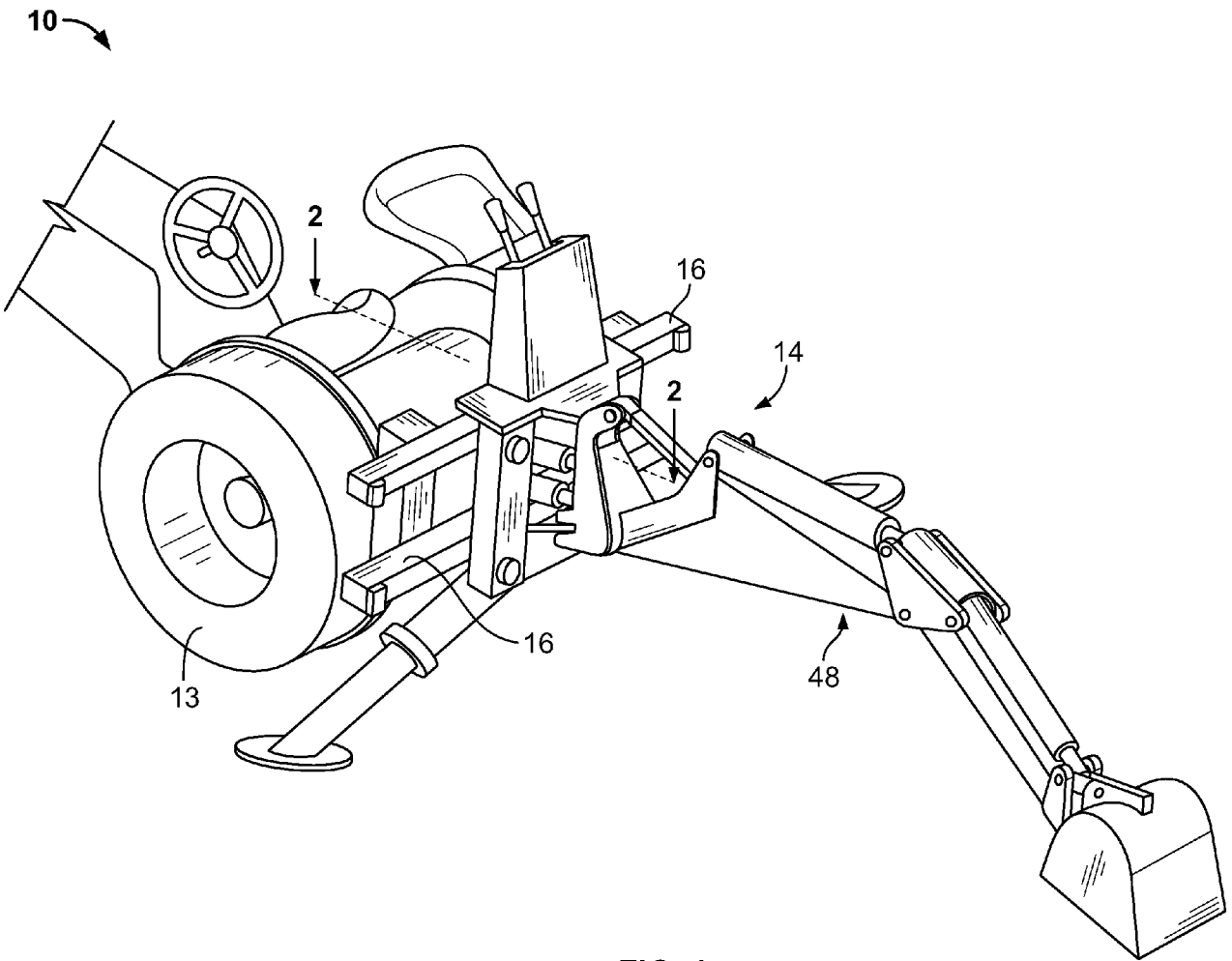
FIG. 1 is a fragmentary perspective view of a vehicle having an earth-working implement attached to the rear end thereof.

FIG. 1 of the drawings generally shows an earth-working vehicle 10 including rear wheels 13 with an earth-working implement 14 secured to the rear end of the vehicle 10. The vehicle 10 has a pair of horizontally oriented, vertically spaced rails 16 secured to the rear end of the vehicle 10. Each of the rails 16 is substantially rectangular in cross section (see FIG. 3) and includes a rear vertical implement support plate 18, with the rails releasably connected to vehicle 10 through quick release frame 17. However, other rail and plate arrangements may be used. As most clearly shown in FIG. 3, tower frame 20 consists of upper and lower plates 22 and 24 that are interconnected by a pair of vertical beams 26. The transversely spaced vertical columns or beams 26 each have a pair of lock members or means 28 supported thereon for securely locking the tower frame 20 in any one of a plurality of adjusted positions with respect to rails 16. These lock members or means may be of the type disclosed in Magee U.S. Pat. No. 3,494,636 or may be hydraulically actuated assemblies well known in the art.

Upper and lower plates 22 and 24 each have a pair of transversely spaced abutments 27 secured thereto by bolts and the abutments engage the forward surfaces of plates 18 while the lower surface of upper plate 22 is supported on the edge of upper plate 18. Thus, the entire tower frame 20 may be laterally shifted with respect to rails 16 and locked in adjusted positions by lock means 28.

Mobile tower frame 20 supports a swing tower 40 that has a substantial C-shaped configuration with upper and lower portions 42 and 44 respectively pivotally supported on upper and lower plates 22 and 24 by pivot pins 46. Pivot pins 46 define a vertical tower pivot axis for supporting swing tower 40 for pivotal movement on tower frame 20. Swing tower 40 supports an implement, such as backhoe 48 for pivotal movement about a horizontal pivot 49. The backhoe 48 is well known in the art.

The swing tower 40 is pivoted with respect to the tower frame 20 by a pair of hydraulic cylinders that are mounted in order to allow the tower frame 20 to be moved along the sliding rails 16 while still having the center of gravity for the backhoe 48 as close as possible to the rear axle for the vehicle 10. As most clearly shown in FIGS. 2 and 3, the tower frame 20 has a support portion consisting of three plates 50 extending between rails 16 and the plates 50 terminating forwardly of the rails 16. The two hydraulic cylinders, which define the swing mechanism for swing tower 40, each include a cylinder barrel 52 and a piston rod 54 that extends from one end of the cylinder barrel 52. Each of the cylinder barrels 52 has a trunnion mounting bracket 56 secured to the cylinder barrel 52 intermediate opposite ends with a pair of trunnions 58 carried by the bracket 56. The trunnions 58 are received in openings 60 in the plates 50 so that the two cylinder barrels 52 are mounted in vertically spaced relation to each other and are located between an adjacent pair of plates 50. Also, the openings 60 are positioned so that both cylinder barrels 52 are supported on a common vertical pivot axis at the forward ends of the plates 50. It will be noted in FIG. 2 that the common pivot axis defined by openings 60 and trunnions 58 are located on a plane P, which extends through the pivot axis defined by pins 46 and this plane is generally parallel to the longitudinal axis of the vehicle 10 and the pivot axis may be located forward of rails 16 and between the rear edges of wheels 13.

Figure 2:
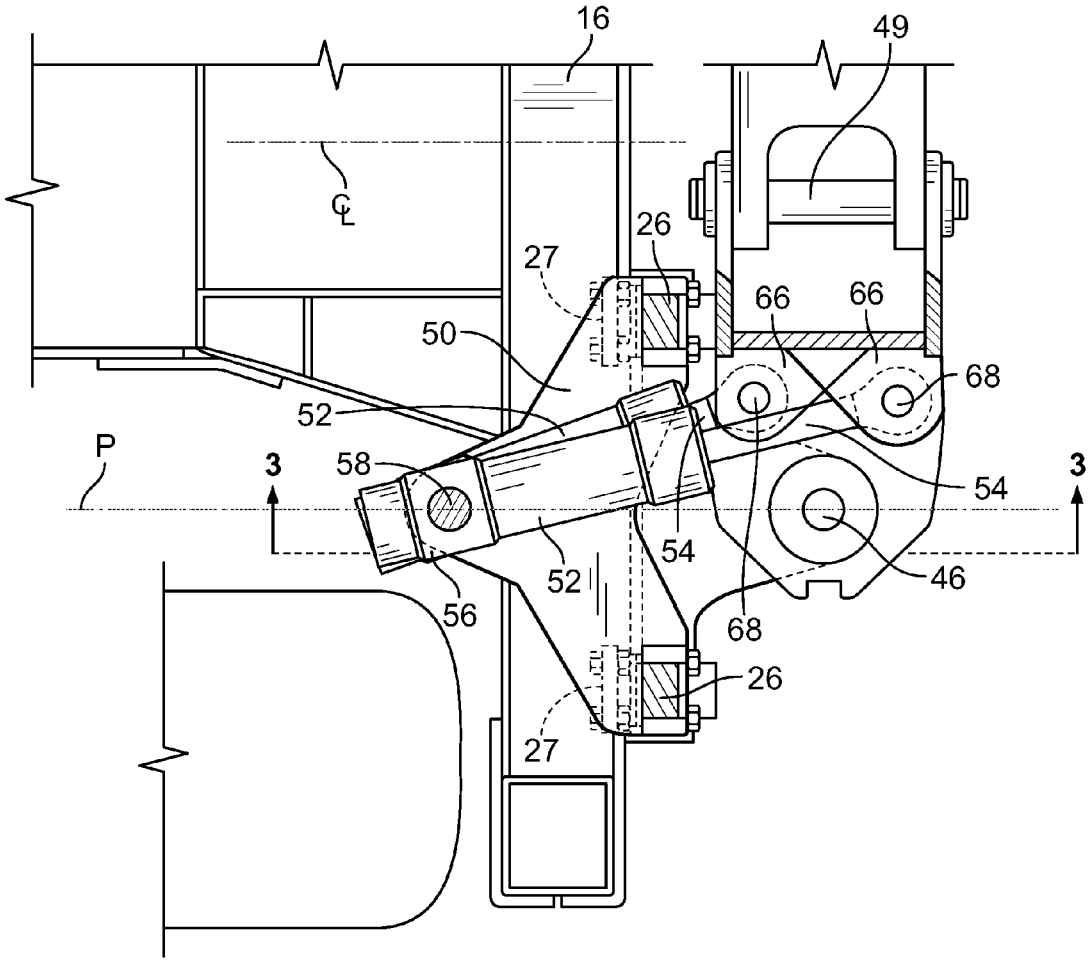
FIG. 2 is an enlarged fragmentary sectional view, as viewed along line 2-2 of FIG. 1.
Figure 3:
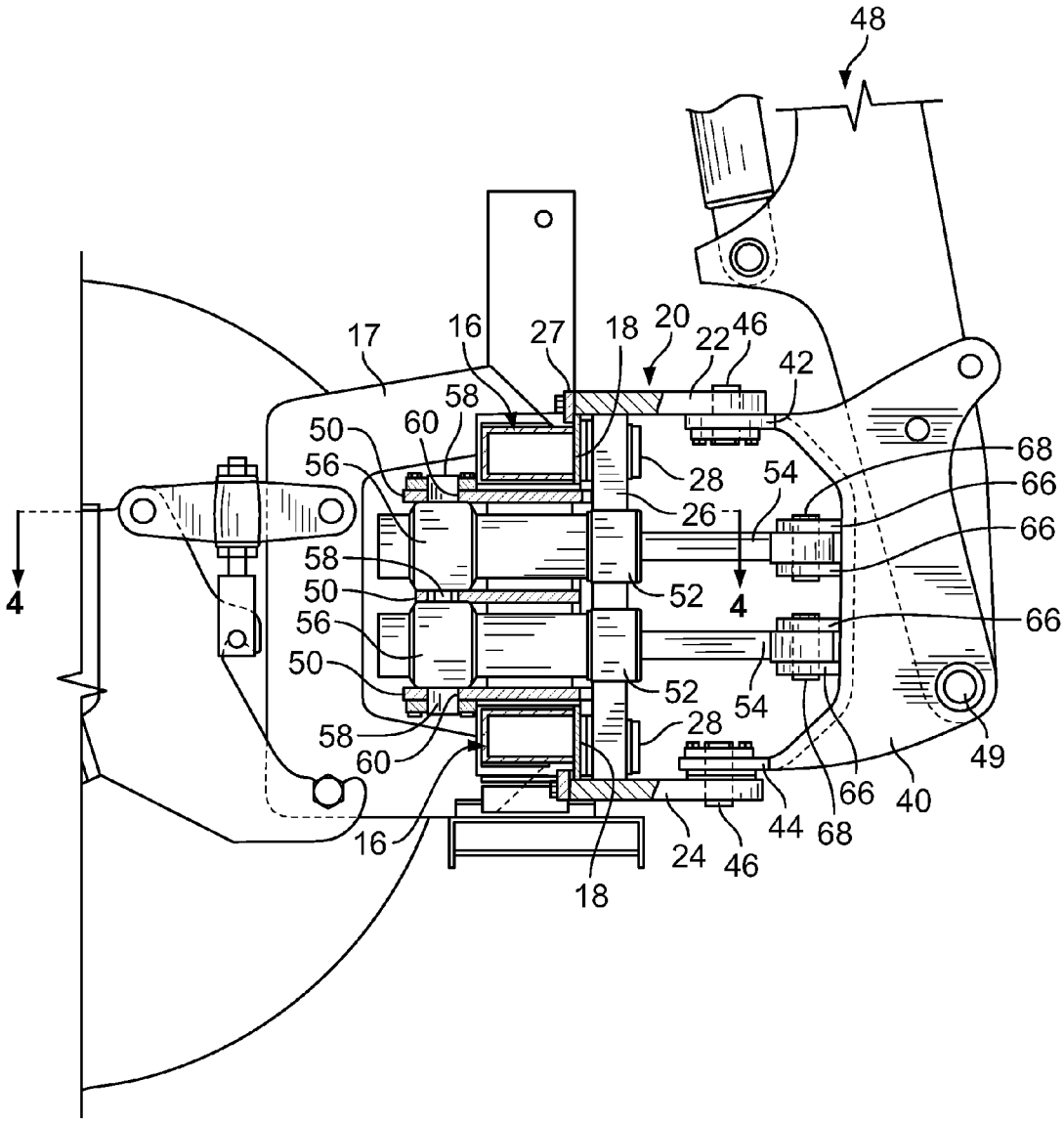
FIG. 3 is an enlarged fragmentary sectional view, as viewed along line 3-3 of FIG. 2.

Piston rods 54 of the hydraulic cylinders are connected to an intermediate portion of the swing tower 40. This connection consists of brackets 66 extending from the body of the swing tower 40 with pins 68 extending through the apertures in the brackets and apertures in the end of piston rods 54. As shown in FIGS. 2 and 3, the piston rods 54 are connected to the intermediate portion of the swing tower 40 at laterally and vertically spaced points, both of which are spaced from the vertical pivot axis defined by pins 46.

Figure 4:
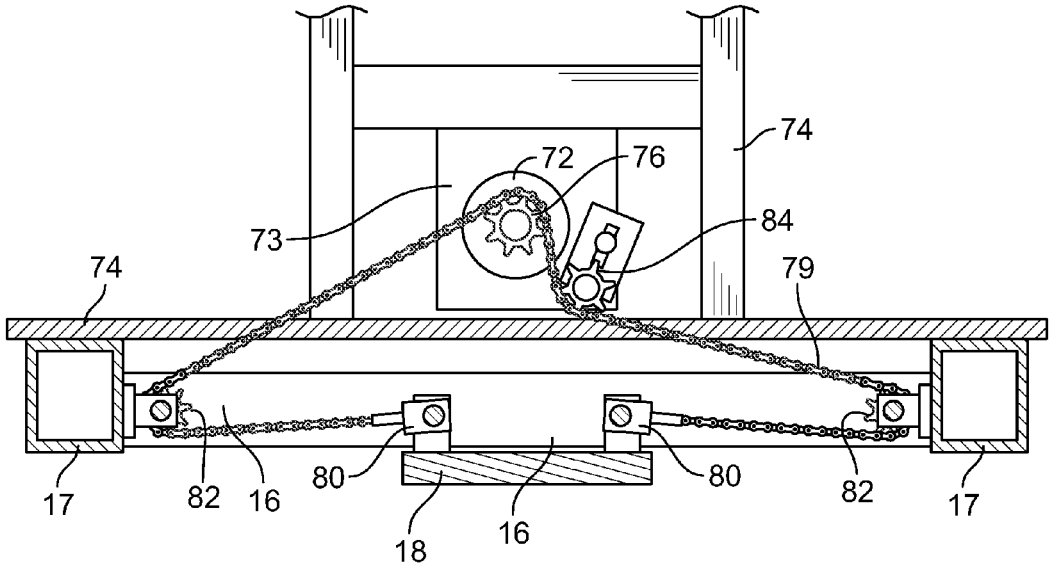
FIG. 4 is a schematic illustration, as viewed along line 4-4 of FIG. 3, showing structural support components.

As shown in FIG. 4, a hydraulic motor 72 is supported on mounting bracket 73 that is securely mounted on the rear end of the vehicle main frame 74. The hydraulic motor 72 provides the motive power to slide the implement support plate 18 and the attached backhoe 48 transversely of the vehicle 10. The hydraulic motor 72 may be a low speed high torque hydraulic motor (LSHT motor). A driving sprocket 76 is mounted on the shaft of the hydraulic motor 72.

The ends of a roller chain 79 are secured to a pair of yoke end connectors 80 that are mounted on the implement support plate 18. See FIG. 4. One end of the roller chain 79 is secured to one of the yoke end connectors 80. The roller chain 79 passes around a chain sprocket 82 mounted to one side of the quick release frame 17 at one end of the rails 16, around the driving sprocket 76, around tensioner sprocket 84 mounted to the mounting bracket 73, around a second chain sprocket 82 mounted to the other side of the quick release frame 17 at the opposite end of the rails 16, and is secured to the second yoke end connector 80. The tensioner sprocket 84 deters the roller chain 79 from jumping out from the sprockets.

The LSHT motor 72 rotates under applied hydraulic pressure from the vehicle hydraulic circuit at very low speeds without need for an intermediate speed reducer, and directly moves the roller chain 79, which moves the backhoe 48. The mechanism is simple with very few parts. Hence, frictional losses are minimal and the system is easy to maintain. The steel roller chain 79 is designed to operate without an enclosure. Due to the short duration and extent of movement, as well as the low speed of operation, the roller chain 79 runs efficiently without lubrication.

By using the present system, movement of the backhoe 48 is controlled. Safety is improved since the controlled movement is without jerking that is prevalent in the prior systems. The present system is compact and improves vehicle maneuverability.

Figure 5:
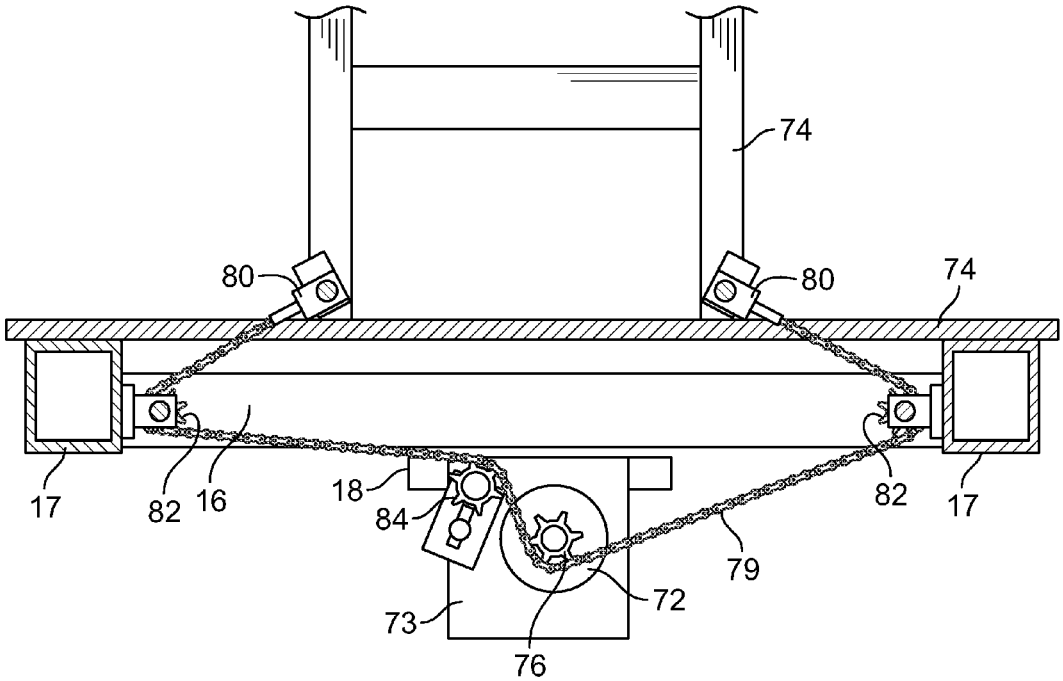
FIG. 5 is a schematic illustration, similar to FIG. 4, showing a second embodiment of the slidable implement support.

A second embodiment of the slidable implement support is shown in FIG. 5. In this embodiment, the mounting bracket 73, on which the hydraulic motor 72 is secured, is mounted on the implement support plate 18 and the yoke end connectors 80 are secured to the main frame 74. One end of the roller chain 79 is secured to one of the yoke end connectors 80 and passes around a chain sprocket 82 mounted to one side of the quick release frame 17 at one end of the rails 16, around the driving sprocket 76, around tensioner sprocket 84 mounted to the mounting bracket 73, around a second chain sprocket 82 mounted to the other side of the quick release frame 17 at the opposite end of the rails 16, and secured to the second yoke end connector 80. A third chain sprocket may be mounted on the mounting bracket 73 opposite the tensioner sprocket 84 to guide the roller chain 79 more parallel to the movement of the implement support plate 18.

Figure 6:
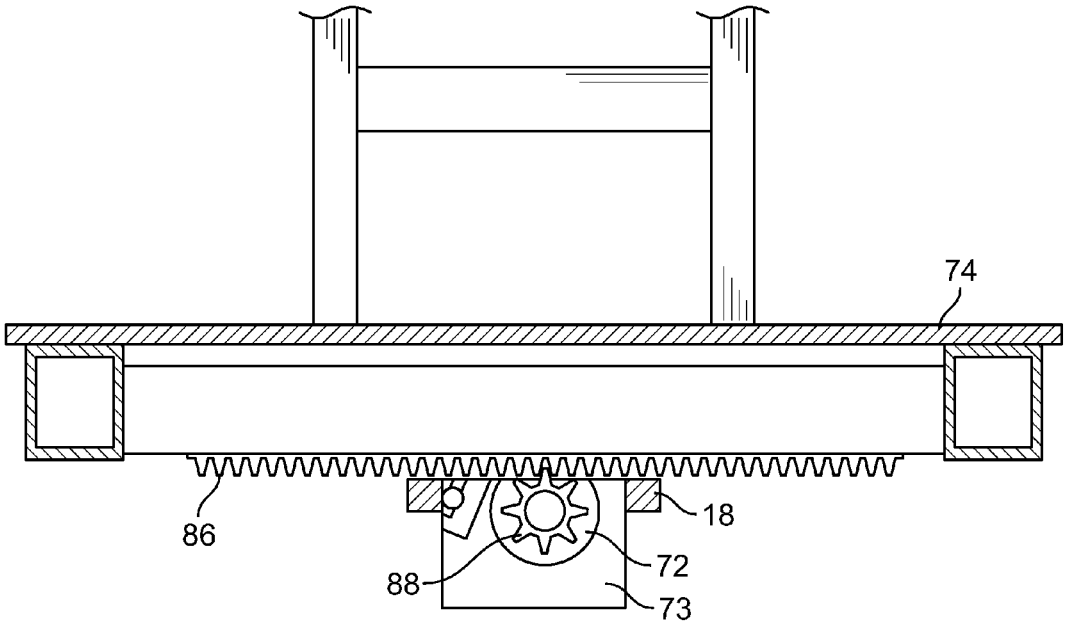
FIG. 6 is a schematic illustration, similar to FIG. 4, showing a third embodiment of the slidable implement support.

In FIG. 6, the mounting bracket 73 and hydraulic motor 72 are mounted on the implement support plate 18 and the roller chain 79 is replaced with a rack 86. The hydraulic motor 72 drives the pinion 88 moving the implement support plate 18 transversely with respect to the vehicle main frame 74.

Figure 7:
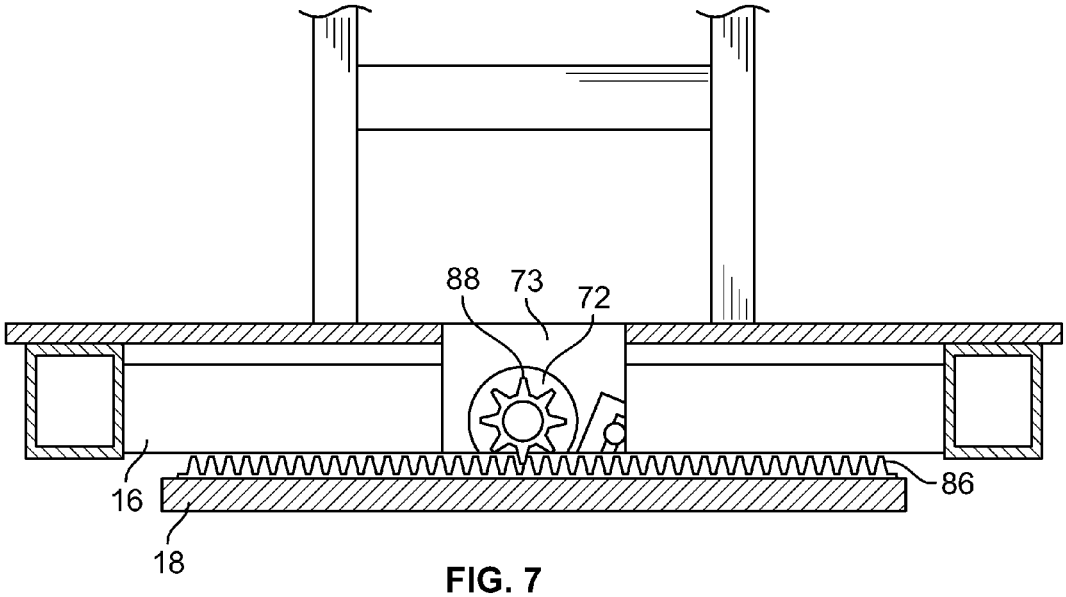
FIG. 7 is a schematic illustration, similar to FIG. 4, showing a fourth embodiment of the slidable implement support.

The mounting bracket 73, hydraulic motor 72 and pinion 88 may be mounted on the rails 16, as shown in FIG. 7. In that case, the rack 86 is mounted on the implement support plate 18.

While the invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

The invention claimed is:

1. An earth-working vehicle comprising an elongated main frame having a longitudinal axis therethrough, an implement support slidingly mounted to the main frame, wherein the implement support is mounted at one end of the main frame and is capable of sliding transversely along an axis of travel with respect to the elongated main frame, and motive means to slide the implement support with respect to the elongated main frame, the motive means comprising (a) a hydraulic motor secured to one of the main frame and the implement support, the hydraulic motor having a driving sprocket or pinion configured for driving rotation about an axis perpendicular to the longitudinal and transverse axes and (b) a motive element selected from the group consisting of (i) a chain having both ends secured to the other of the main frame and the implement support and (ii) a rack secured to the other of the main frame and the implement support.

2. The vehicle of claim 1, wherein the hydraulic motor is directly secured to the main frame.

3. The vehicle of claim 2, wherein the motive element is a chain having both ends secured to the implement support.

4. The vehicle of claim 3, wherein the motive means further comprises a tensioner sprocket secured to the main frame to keep the chain under tension.

5. The vehicle of claim 3, wherein the main frame comprises a horizontally oriented main frame support member at one end of the main frame and the motive means further comprises a pair of chain sprockets, one of the chain sprockets being secured to each end of the horizontally oriented main frame support member, the chain passing around each chain sprocket intermediate the hydraulic motor and the end of the chain, the motive means configured such than when driven by the motor, the chain applies a pulling force on the implement support in a direction generally parallel to the axis of travel.

6. The vehicle of claim 2, wherein the motive element is a rack secured to the implement support.

7. The vehicle of claim 1, wherein the hydraulic motor is secured to the implement support.

8. The vehicle of claim 7, wherein the motive element is a chain having both ends secured to the main frame.

9. The vehicle of claim 8, wherein the motive means further comprises a tensioner sprocket secured to the implement support to keep the chain under tension.

10. The vehicle of claim 8, wherein the main frame comprises a horizontally oriented main frame support member at one end of the main frame and the motive means further comprises a pair of chain sprockets, one of the chain sprockets being secured to each end of the horizontally oriented main frame support member, the chain passing around each chain sprocket intermediate the hydraulic motor and the end of the of the chain.

11. The vehicle of claim 7, wherein the motive elements is a rack secured to and projecting rearward from the main frame such that the rotation forces applied from the motor to the rack are within generally a generally longitudinal plane perpendicular to axis of travel.

12. The vehicle of claim 1, wherein a backhoe is secured to the implement support.

13. The vehicle of claim 1, wherein the hydraulic motor is a low speed high torque hydraulic motor.

14. A method of positioning an implement support relative to the elongated main frame of an earth-working vehicle comprising:

mounting the implement support on the main frame of the earth-working vehicle at one end of the elongated main frame for transverse sliding with respect to the main frame along an axis of travel;

mounting a motive means on the earth-working vehicle, wherein the motive means comprises (a) a hydraulic motor secured to one of the main frame and the implement support, the hydraulic motor having a driving sprocket or pinion configured for providing rotation forces to a motive element in a plane perpendicular to the axis of travel and (b) the motive element selected from the group consisting of (i) a chain having both ends secured to the other of the main frame and the implement support and (ii) a rack secured to the other of the main frame and the implement support; and rotating the driving sprocket or pinion of the motor until the implement support in is at the desired position relative to the elongated main frame of an earth-working vehicle frame and is capable of sliding transversely with respect to the elongated main frame, and motive means to slide the implement support with respect to the elongated main frame, the motive means comprising (a) a hydraulic motor secured to one of the main frame and the implement support, the hydraulic motor having a driving sprocket or pinion configured for transmitting rotation forces to a motive element within an axis parallel to the first plane and (b) a motive element selected from the group consisting of (i) a chain having both ends secured to the other of the main frame and the implement support and (ii) a rack secured to the other of the main frame and the implement support.

15. The method of claim 14, wherein the hydraulic motor is directly secured to the main frame.

16. The method of claim 15, wherein the motive element is a chain having both ends secured to the implement support.

17. The method of claim 16, wherein the motive means further comprises a tensioner sprocket secured to the main frame to keep the chain under tension.

18. The method of claim 16, wherein the main frame comprises a horizontally oriented main frame support member at one end of the main frame and the motive means further comprises a pair of chain sprockets, one of the chain sprockets being secured to each end of the horizontally oriented main frame support member, the chain passing around each chain sprocket intermediate the hydraulic motor and the end of the one of the chain, the motive means configured such than when driven by the motor, the chain applies a pulling force on the implement source in a direction generally parallel to the axis of travel.

19. The method of claim 15, wherein the motive element is a rack secured to the implement support.

20. The method of claim 14, wherein a backhoe is secured to the implement support.

* * * * *